United States Patent [19]

Gubela

[11] 4,027,591

[45] June 7, 1977

[54] APPARATUS FOR POSITIONING A PAD OR BOOK OF SHEETS ON THE WORK TABLE OF PRINTING APPARATUS

[76] Inventor: Hans Gubela, Hackenstrasse 8, 8211 Rottau, Germany

[22] Filed: Mar. 26, 1975

[21] Appl. No.: 562,050

[52] U.S. Cl. ..... 101/407 BP; 83/467 R; 101/415; 269/319; 271/236

[51] Int. Cl.[2] ..... B41F 1/28; B65H 9/08; B26D 7/16

[58] Field of Search ..... 101/407 BP, 407 R, 413, 101/414, 415.1, 415, DIG. 12, 287, 316, 3, 4; 83/467, 467 A; 269/315, 316, 317, 318, 319; 271/236, 245, 246

[56] References Cited

UNITED STATES PATENTS

| | | | |
|---|---|---|---|
| 569,761 | 10/1896 | McCollin | 101/413 X |
| 1,149,240 | 8/1915 | Winter | 101/407 BP |
| 1,492,688 | 5/1924 | Hidalgo | 101/413 X |
| 2,065,690 | 12/1936 | Gould et al. | 101/3 R |
| 2,438,639 | 3/1948 | Lawrence | 101/407 R |
| 2,488,205 | 11/1949 | Kopczynski | 83/467 A X |
| 3,595,167 | 7/1971 | Wirth | 101/287 |
| 3,665,795 | 5/1972 | Mayer | 83/467 |
| 3,667,334 | 6/1972 | Brunett | 83/467 |
| 3,868,904 | 3/1975 | Wulf | 101/316 |

FOREIGN PATENTS OR APPLICATIONS

| | | | |
|---|---|---|---|
| 709,516 | 5/1954 | United Kingdom | 271/245 |

*Primary Examiner*—Edgar S. Burr
*Assistant Examiner*—Paul J. Hirsch
*Attorney, Agent, or Firm*—Gipple & Hale

[57] ABSTRACT

Apparatus for the positioning of a loose leaf or bound pad or book on the work table of an apparatus for printing the individual leaves of the pad or book comprising a holder member which is disposed to extend transversely of the work table and located on or near one end of the work table. The holder member is movable in a plane normal to the upper surface of the work table between a raised inoperative position which allows introduction of a pad or book between the holder and the work table and a lowered operative position in which it can contact and hold the pad or book securely in its position on the work table, a plurality of movable positioning studs for locating the position of the pad or book on the table, are disposed both on a line extending longitudinally of the work table as well as on a line extending transversely of the work table and which are located to one side of the leaf-holder, the positioning studs so co-operating with the leaf-holder that in the operative position of the leaf-holder they are disposed in a downwardly depressed inoperative position, whereas when the leaf-holder is in its inoperative position, they are in their operative position in which they project upwardly from the work table to position a pad or book in the correct position on the work table.

3 Claims, 2 Drawing Figures

APPARATUS FOR POSITIONING A PAD OR BOOK OF SHEETS ON THE WORK TABLE OF PRINTING APPARATUS

This invention relates to apparatus for positioning a loose leaf or bound pad or book of sheets, in particular a cheque book, on the work table of an apparatus for printing the individual sheets of the pad or book.

In order to print the individual sheets of a pad or book, particularly sheets of a cheque book, in the correct manner in a printing apparatus specially intended for the purpose, i.e. in order to be able to provide them with the necessary account number or other figures or letters, it is necessary for the pad or book to be easily and rapidly insertable into the printing apparatus, onto the work table thereof, with an assurance of the pad being immediately located and held in its correct position on the work table, the correct position being that in which the individual sheets of this pad or book can be printed one after another.

For example, in the case of a cheque form in which printing of for instance the account number, must be effected to an accuracy of one-tenth of a millimeter with respect to depth and length of the sheet, it is necessary therefore that positioning of the cheque form for optically legible printing or for so-called magnetic printing, be effected with extreme accuracy in the reading zone, which means that the necessary imprinting of the account number or the like on the cheque form does not only — as in the imprinting of a normal text or number — have to fit to an accuracy of several millimeters into an area provided for the purpose.

An embodiment of the invention aims to provide a positioning device of the type mentioned above, which does not significantly increase the cost of manufacturing the printing apparatus as a whole, but is nevertheless not susceptible to breakdown and permits of rapid as well as simple positioning or fixing of the book or pad on the work table of the printing apparatus without any specialist labour being required for the purpose.

According to the present invention there is provided apparatus for the positioning of a loose leaf or bound pad or book on the work table of an apparatus for printing the individual leaves of the pad or book, comprising a holder member which is disposed to extend transversely of the work table and located on or near one end of the work table. The holder member is movable in a plane normal to the upper surface of the work table between a raised inoperative position which allows introduction of a pad or book between the holder and the work table and a lowered operative position in which it can contact and hold the pad or book securely in its position on the work table. A plurality of movable positioning studs for locating the position of the pad or book on the table, are disposed both on a line extending longitudinally of the work table as well as on a line extending transversely of the work table and which are located to one side of the leaf-holder, the positioning studs so co-operating with the leaf-holder that in the operative position of the leaf-holder they are disposed in a downwardly depressed inoperative position, whereas when the leaf-holder is in its inoperative position, they are in their operative position in which they project upwardly from the work table to position a pad or book in the correct position on the work table.

It is thus ensured in an easy and advantageous manner that whenever a pad or book is inserted as far as it will go into the apparatus and abuts the positioning studs, the leaf holder is rendered inoperative in the desired manner and that on the other hand when the leaf holder is in its operative position, the positioning studs are rendered inoperative so that they cannot affect the working of the printing apparatus.

In a further development of the invention, at least three positioning studs are provided at a distance from one another, two positioning studs flush with one another in the longitudinal direction being disposed on one long side of the work table to define the lateral position of the forms pad while at a right-angle thereto, in order to define the length of insertion of the forms pad, one positioning stud is provided on the narrow side of the work table which is opposite the leaf holder. These positioning studs may be guided in or be upwardly and downwardly movable in appropriate bores provided in the work table and are then secured approximately at right-angles to a movable mounting plate provided underneath the work table.

Preferably the narrow side of the mounting plate, the side opposite the narrow side which carries the individual positioning studs, is articulated on the underside of the work table.

The invention further provides for the mounting plates to be subject to the action of a draw spring which has one end attached to the mounting plate while its other end is stationary, the draw spring tending to pivot the mounting plate, together with the positioning studs, upwardly into the operative position, the mounting plate, by means of a push stud fixed to it, so co-operating with the leaf holder that when the leaf holder is displaced downwardly into the operative position, it is pivoted downwardly into the inoperative position in which the positioning studs are depressed into their bores. Advantageously, the push stud mounted on the mounting plate passes through a bore in the working table in the zone of operation of the leaf-holder and bears on the underside of the leaf-holder.

A reliable gripping of the forms pad on the work table is achieved if the leaf-holder co-operating with the push stud of the mounting plate is constructed so that in cross-section it is a more or less U-shaped member, the arms of which project downwardly, the member being guided for upwards and downwards movement in an approximately vertical leaf-holder stand.

The leaf-holder can advantageously be pressed downwardly into the operative position by means of a thrust spring, one end of which is braced on the upper face of the leaf-holder while its other end is braced on the bottom of a recess provided in the stand.

In contrast, the leaf-holder may be displaceable upwardly into the inoperative position against the action of the thrust spring by means of an actuating lever articulated transversely in front of the leaf-holder stand, the leaf-holder, when in the inoperative position, being held by means of a locking arm which co-operates with the actuating lever.

It lies within the scope of the invention for the actuating lever to have an actuating grip at one end while its other end, opposite the actuating grip with reference to the point of articulation of the actuating lever on the stand, is articulated on a guide pin of the leaf-holder.

The locking lever may be articulated on the leaf-holder stand above the actuating lever and, close to its free end, may have an abutment which co-operates with the actuating lever and on which is braced the actuating lever which is pivoted downwardly until the inoperative position of the leaf-holder is reached. It is finally envisaged that the locking lever be capable of disengagement from the actuating lever against the action of a spring.

An embodiment of the invention will now be described with reference to the accompanying drawings, in which.

Figure 1:
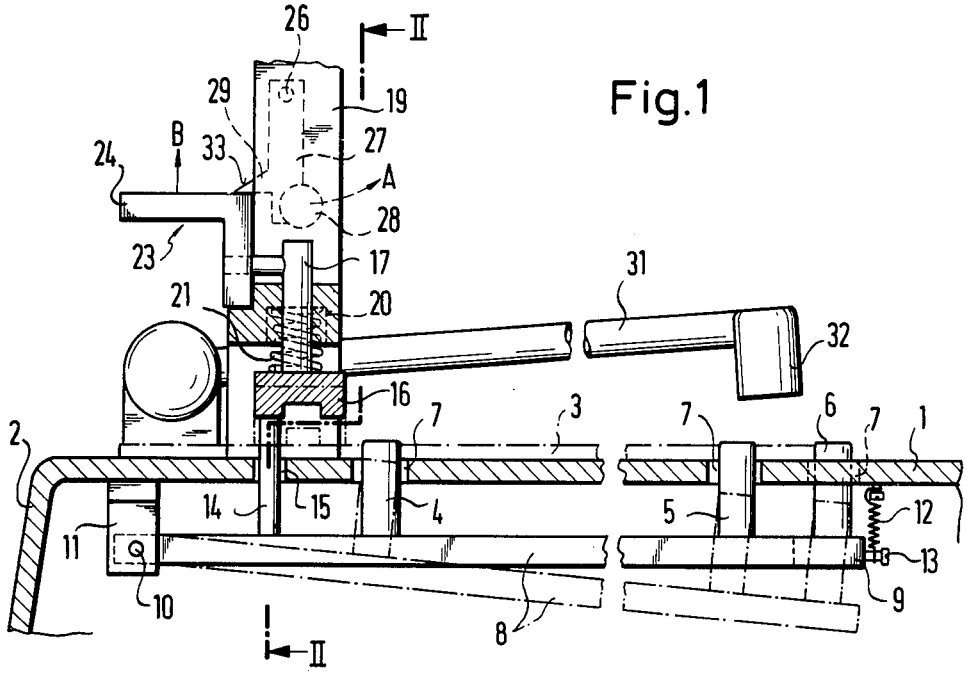
FIG. 1 is a horizontal longitudinal section through the positioning means.

The printing apparatus is not shown in the drawings but is provided with a work table 1 on which, so long as the printing apparatus is working, a book or pad 3 of sheets consisting of loose or bound individual leaves, can be placed, the pad 3 being inserted from the front end 2 of the apparatus, and after being positioned in its correct location is held in this position in order to be printed, stamped and the like by the printing apparatus.

For positioning of the book or pad 3 in its correct location on the work table 1, in the embodiment illustrated, three positioning studs 4, 5 and 6 are provided. FIG. 1 shows in solid lines their operative position in which they project upwardly through the table 1 to the required height above the work table 1 so that they serve as stops to define the correct position of the book or pad 3 which is inserted into the printing apparatus. The two positioning studs 4 and 5 in this case define the lateral location of the book or pad 3 and, in the longitudinal direction of the pad, they are disposed in alignment with each other along one long side of the work table 1. The positioning stud 6 serves to define the longitudinal location of the inserted book or pad 3 and is disposed on the narrow side of the approximately rectangular work table 1 which is opposite the front wall 2 of the apparatus, so that a right-angle is formed between the positioning stud 6, the positioning stud 5 and the angular corner of the work table 1 which is enclosed between the two positioning studs 5 and 6.

The positioning studs 4, 5 and 6 extend through appropriately positioned bores 7 provided in the table 1 through which they are guided in a suitable manner. The positioning studs 4, 5 and 6 are attached at their bottom ends to a mounting arm 8 and extend at right angles to the arm 8. The side edges 9 of the mounting arm 8 have integral pivots 10, 10′ which are carried in mounting brackets 11, 11′ respectively. These mounting brackets 11, 11′ are formed as approximately L-shaped angled pieces which are located at a suitable distance from each other and which have one limb attached to the underside of the work table 1, while their other limb serves as a mounting for the mounting of the corresponding pivots 10, 10′ of the mounting arm 8. In this way, the arm 8 can be pivoted out of the operative position, shown in solid lines in FIG. 1 and in which the positioning studs 4, 5 and 6 extend through their associated bores 7, projecting upwardly of the work table and position the book or pad 3 in its correct location, and pivoted downwardly into the inoperative position shown in dash-dotted lines in FIG. 1, in which the positioning studs 4, 5 and 6 are retracted from their operative position, with the help of an abutment (still to be explained) between a leaf-holder and a push stud. The spring 12 is, as can be seen from FIG. 1, attached at one end to the underside of the work table 1 while its other end is attached to a screw 13 which is screwed into the end of the mounting arm 8 which carries the positioning stud 6.

Between its hinge point 10, 10′ and the positioning stud 4, the mounting arm 8 carries a push stud 14 which extends approximately at right-angles thereto. The push stud 14 is of a length which projects upwardly beyond the work table 1 and passes through a bore 15 provided in the region of the narrow insertion side of the work table 1.

The push stud 14 can by means of the mounting arm 8 be moved against the action of the spring 12 out of the operative position downwardly into an inoperative position. The push stud 14 co-operates with an upwardly and downwardly movable leaf-holder 16. The leaf-holder 16 is disposed parallel to the narrow insertion side of the work table 1 and extends across the table 1 as can be seen in FIG. 1. The holder 16 is of channel-shaped cross-section and the two limbs of the channel project downwardly and in the downwardly displaced operative position of the leaf-holder 16, shown by dash-dotted lines in FIG. 1, hold the book or pad 3 reliably in the position which is automatically determined by the positioning studs 4, 5 and 6. By virtue of the action of the draw spring 12, the push stud 14 of the mounting arm 8 has its free end always bearing against the downwardly projecting end face of one limb of the channel section leaf-holder 16, so that the push stud 14 is constrained to follow every upwards or downwards movement of the leaf-holder 16.

The leaf-holder 16 is guided for upwards and downwards movement by guide pins which engage in recesses 18, said guide pins 17 being attached to the upper side of the holder 16 and extending approximately at right-angles thereto. In the illustrated embodiment three guide pins 17 are provided. The recesses 18 are provided in a stand 19 for supporting the leaf-holder 16. The stand 19 is disposed approximately at right-angles to the table 1 and extends over the insertion end of the work table 1 and has a vertically extending recess 20. A thrust spring 21 has one end braced against the bottom of this cut-out 20 while its other end is braced against the upper face of the leaf-holder 16 so that under the action of the thrust spring 21, the leaf-holder 16 always tends to move downwardly into the operative position shown in dash-dotted lines in FIG. 1.

Located transversely in front of the stand 19 is an actuating lever 23 which is carried on a pivot 22, one end of the lever having an actuating grip 24. The other end 25 of the actuating lever 23 which is beyond the pivot point 22, is articulatingly connected to the middle guide pin 17 of the holder 16 in the manner shown in FIGS. 1 and 2. The structural connection of the actuating lever 23 to the leaf-holder 16 can of course also be effected in any other manner than that illustrated. In any case, however, the nature of the hinging of the actuating lever 23 between its two ends, 24, 25 ensures that by depressing of the actuating grip 24 of the lever 23, the leaf-holder 16 is displaced upwardly against the action of the thrust spring 21 so that the leaf-holder 16, when no pressure any longer is being exerted on the actuating grip 24 of the lever 23, will move downwardly under the action of the spring 21 until it rests on the book or pad 3.

Articulated on one narrow side of the leaf-holder stand 19, above the actuating lever 23, at 26, is a locking lever 27 which has an actuating knob 28 and, close to its free end, a stop 29. The stop 29 of the locking lever 27, which is constructed in the form of a projection or the like, projects in the direction of the actuating grip 24 of the lever 23 and co-operates therewith in such a way that the actuating lever 23 can by means of the stop 29 be arrested in its downwardly pivoted position, the actuating grip 24 or lever 23 being braced from below against the stop 29.

Figure 2:
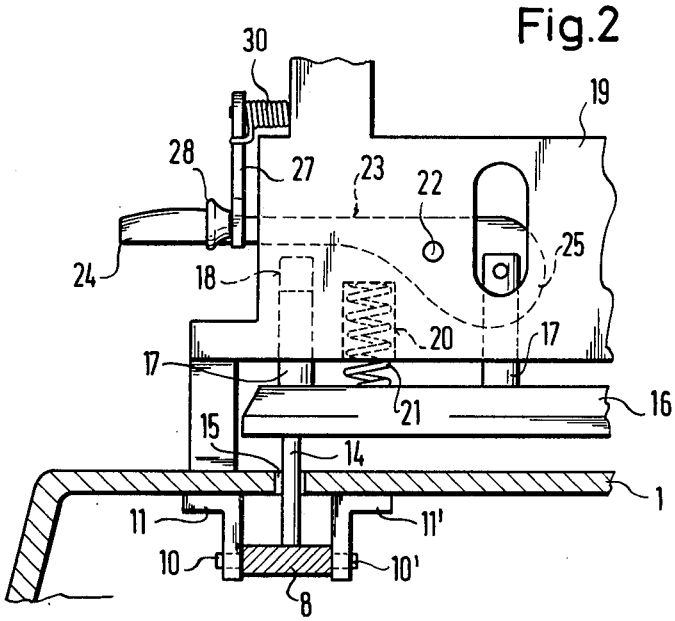
FIG. 2 is a cross-section taken along the line II—II shown in FIG. 1.

As FIG. 2 shows, the locking lever 27 is subject to the action of a spring 30 provided at the hinging point 26, having one end engaged behind the locking lever 27 while its other end is anchored in the leaf-holder stand 19. In this way, the locking lever 27 is constantly endeavouring to pivot in a clockwise direction as shown in FIG. 1.

For turning over the individual leaves of the book or pad 3 during operation of the printing apparatus, there is disposed on a pivot arm 31 a suction head 32, the pivot arm 31 resting on the leaf-holder 16 and so co-operating with this latter that in the case of the upwardly displaced inoperative position of the leaf-holder 16, as shown in FIG. 1, it is likewise pivoted upwardly thereby, together with the suction head 32, and is at a sufficient distance from the work table 1 that insertion of the form pad 3 onto the work table 1 is not impeded. When, on the other hand, the leaf-holder 16 is lowered into its operative position and is holding the book or pad 3 in the envisaged correct position, the pivot arm 31 is likewise lowered together with the suction head 32, the latter resting on the desired place on the topmost leaf of the book or pad 3.

The apparatus functions as follows:

In order to be able to insert the book or pad 3 into the printing apparatus, it is necessary to open the leaf-holder 16 i.e. to bring it into its upwardly displaced inoperative position. For this purpose, the actuating lever 23 is pivoted about its hinge 22 by the actuating grip 24 being depressed, during which process, by virtue of its upper edge 33 which co-operates with the actuating lever 23, the locking lever 27 is pivoted backwards in an anti-clockwise direction according to FIG. 1, i.e. in the direction of the arrow A, against the action of the spring 30. The depressing of the actuating grip 24 of the lever 23 causes the lever end 25 to pivot upwardly, so that also the leaf-holder 16, slidingly guided by its guide pins 17 in the recesses 18 in the leaf-holder stand 19, is also displaced upwardly into its inoperative position, against the action of the spring 21. In consequence, at the same time, the pivot arm 31 resting on the leaf-holder 16 is pivoted upwardly together with the suction head 32 which is disposed thereon.

As already mentioned, the push stud 14 of the mounting arm 8 which bears on one arm of the U-shaped leaf-holder 16 follows this upwards (into the inoperative position) displacement movement of the leaf-holder 16, since of course the draw spring 12 is constantly seeking to pivot the mounting arm 8 and thus also the push stud 14 upwardly. In the completely downwardly depressed position of the actuating grip 24, the upper side thereof becomes positioned below the stop 29 of the locking lever 27, so that this latter, under the action of its spring 30, can pivot in a clockwise direction according to FIG. 1 so that the stop 29 moves into the range of movement of the actuating grip 24 or lever 23. If, then, no pressure is any longer exerted on the actuating grip 24 of the lever 23, the lever 23 nevertheless remains in the position shown in FIGS. 1 and 2, since the actuating grip 24 is braced against the stop 29 of the locking lever 27 under the action of the thrust spring 21.

In this inoperative position of the leaf-holder 16, illustrated in FIG. 1 by means of solid lines, the positioning studs 4, 5 and 6 which are pivoted upwardly together with the push stud 14 of the mounting arm 8, assume their operative position, likewise shown by solid lines in FIG. 1, and in which they project through the bores 7 and above the work table 1. This operative position which is maintained by the draw spring 12 is defined or limited in that the push stud 14 which is of a definite length, rests against one arm of the U-shaped leaf-holder 16.

It is now possible to insert the book or pad 3 from the front end 2 of the printing apparatus under the open leaf-holder 16 and onto the work table 1, in fact sufficiently far for the book or pad 3 to rest against the positioning studs 4, 5 and 6. Thus, a positioning of the lateral location as well as of the length to which the form pad 3 is inserted can be automatically and completely achieved without the need for any specially trained operator or any special handling.

When the book or pad 3 is correctly positioned on the work table 1, it is necessary to secure the book or pad 3 in this position. This is achieved by the leaf-holder 16 being moved into its downwardly displaced operative position shown by dash-dotted lines in FIG. 1. For this purpose, the actuating grip 24 of the lever 23 is pressed somewhat downwardly and the locking lever 27 is then pivoted by hand in the direction of the arrow A, i.e. in a clockwise direction as shown in FIG. 1, by gripping of the actuating knob 28. Consequently, the stop 29 of the locking lever 27 is disengaged from the actuating grip 24 so that this latter can pivot upwardly in the direction of the arrow B about the hinging point 22, under the action of the spring 21. Thus, the other end 25 of the lever pivots downwardly so that the leaf-holder 16 is likewise displaced downwardly under the action of its thrust spring 21, in fact so long as or that is to say sufficiently for the leaf-holder to rest firmly on the form pad 3, holding it securely and immovably in the position determined by the positioning studs 4, 5 and 6.

Upon the downwards displacement of the leaf-holder 16, not only the pivot lever 31 lowers onto the book or pad 3 together with the suction head 32, but also the push stud 14 has been constrained to move downwardly by one of the arms of the leaf-holder 16 so that also the positioning studs 4, 5 and 6 are depressed out of their operative position shown in solid lines in FIG. 1 downwardly into the inoperative position indicated by the dash-dotted lines and in which they do not impede the operation of the printing apparatus. Upon completion of the printing, stamping and the like of the book or pad 3, in order to remove this book or pad 3, it is necessary only to move the leaf-holder 16 again into its inoperative position in the manner described, whereupon, at the same time, the positioning studs 4, 5 and 6 are automatically moved into their operative position and in consequence a new book or pad 3 can immediately be inserted into the apparatus.

Naturally, it is possible instead of providing only three positioning studs also to provide more than three positioning studs if this is desired.

Altogether, inter alia, the setting of the leaf-holder 16 in the open position for insertion of the books or pads 3 and in the depressed position and the height of the projecting positioning studs 4, 5 and 6, afford the advantageous possibility of positioning and securely holding sheets of forms, whether they are bound together or loose, to an extent of one leaf up to sixty leaves always with the same accuracy. In addition, both the positioning studs 4, 5 and 6 as well as the bore which is defined at the top of the leaf-holder 16, are so disposed that both the narrowest conventional bank-type forms as well as the widest payment forms can always be inserted in the same way into the apparatus and be fixed for the intended printing without the apparatus described requiring to be adjusted.

What we claim is:

1. Apparatus for the positioning of a loose leaf or bound pad or book on the work table of an apparatus for printing the individual leaves of the pad or book comprising a holder member which cross-section is of an inverted channel configuration, said holder member being disposed to extend traversely of the work table and located along one end of the work table and movable in a plane normal to the upper surface of the work table by being guided for upward and downward movement in a substantially vertical stand between a raised inoperative position which allows introduction of a pad or book between the holder and the work table and a lowered operative position in which said holder member can contact and hold the pad or book securely in its position on the work table, in which the work holder is acted upon by a spring, one end of which bears on the upper face of the work holder while its other end is braced on the bottom of a recess provided in the stand, the work holder being urged downwardly by the spring into the operative position, a reciprocating actuating lever for moving said holder mounted for traverse movement in the front of the stand, said lever being displaceable against the action of said spring to move the work holder upwardly into its inoperative position, in which position said lever is held by means of a locking lever which cooperates with the actuating lever, said actuating lever having at one end an actuating grip while its other end, which is on the other side of the hinging point of the lever on the stand, is activated on a guide pin connected to the work holder, and a plurality of moveable positioning studs for locating the position of the pad or book on the table, said studs being disposed both on a line extending longitudinally of the work table as well as on a line extending traversely of the work table and located to one side of the work holder, the positioning studs so co-operating with the work holder that in the operative position of the work holder they are disposed in a downwardly depressed inoperative position, while when the work holder is in its inoperative position, they are in their operative position in which they project upwardly from the work table to position a pad or book in the correct position on the work table.

2. Apparatus as claimed in claim 1, in which the locking lever is articulated on the leaf-holder stand above the actuating lever and has close to its free end stop which co-operates with the actuating lever and which engages with the actuating lever when the actuating lever is pivoted downwardly to raise the holder to its inoperative position.

3. Apparatus as claimed in claim 2, in which the locking lever is urged in a direction to disengage it from the actuating lever by the action of a spring.

* * * * *